US005450924A

United States Patent [19]

Tseng

[11] Patent Number: 5,450,924

[45] Date of Patent: Sep. 19, 1995

[54] PORTABLE OIL SUCTION DEVICE

[76] Inventor: Tien-Tsai Tseng, No.35-10, Liu Ku Road, Wu feng Hsiang, Taichung Hsien, Taiwan

[21] Appl. No.: 368,902

[22] Filed: Jan. 5, 1995

[51] Int. Cl.[6] ..... F16N 33/00; F16N 13/08

[52] U.S. Cl. ..... 184/1.5; 184/28; 184/108; 137/202; 141/65; 141/198

[58] Field of Search ..... 184/1.5, 28, 34, 108; 137/202; 222/65, 67, 69, 401; 141/65, 98, 198

[56] References Cited

U.S. PATENT DOCUMENTS

| | | | |
|---|---|---|---|
| 669,819 | 3/1901 | Brooks | 222/401 |
| 3,002,522 | 10/1961 | Klinefelter | 137/202 |
| 3,340,887 | 9/1967 | Peters | 137/202 |
| 3,586,032 | 6/1971 | Weinstein | 137/202 |
| 5,002,154 | 3/1991 | Chen | 184/1.5 |

FOREIGN PATENT DOCUMENTS

| | | | |
|---|---|---|---|
| 0518351 | 3/1955 | Italy | 184/28 |

*Primary Examiner*—Edward K. Look
*Assistant Examiner*—Christopher Verdier
*Attorney, Agent, or Firm*—Morton J. Rosenberg; David I. Klein

[57] ABSTRACT

A portable oil suction device including a solid oil tank, a top cover securely fixed to the top open end of the oil tank and having a unitary handle for carrying by hand, a pump cylinder disposed inside the oil tank, a plunger moved in the pump cylinder to induce a suction force for drawing engine oil from an engine into the oil tank, and a control valve carried on a link on the bottom side of the top cover and controlled by a float to stop the air passage on the cover when the engine oil in the oil ,tank reaches the high oil level.

1 Claim, 6 Drawing Sheets

PORTABLE OIL SUCTION DEVICE

BACKGROUND OF THE INVENTION

The present invention relates to a portable oil suction device for sucking the engine oil out of an engine.

U.S. Pat. No. 5,002,154 discloses a portable oil suction device for use to draw the engine oil away from an engine. This device mainly comprises a top cover 81, an oil tank 82, a bottom cover 83, a pump to cylinder 84, a plunger 85, a fuse valve 86, and an exhaust hole 87. This structure of portable oil suction device is still not satisfactory in function. When the engine oil is drawn into the oil tank, bubbles will be produced. Furthermore, an oil leakage tends to occur at the connecting area between the oil tank 82 and the bottom cover 83.

FIG. 2 strops another structure of portable oil suction device in which an annular air bag 97 is mounted around the pump cylinder for eliminating the formation of bubbles during the operation of the portable oil suction device, a float mechanism 96 is installed in the bottom side of the top cover to automatically stop the air passage when the oil level inside the oil tank reaches the predetermined range, and hand-operated relief valve 99 is installed to release air out of the oil tank. However, this structure of portable oil suction device still has drawbacks. As indicated in FIG. 2, the top cover 92 has a tubular top flange 922 with two symmetrical protruding portions 923 and recessed portions 924, the plunger rod 91 has two opposite retainer rods 912 near the cross hand-hold portion 911. When the plunger rod 91 is moved to the lowest position, the retainer rods 912 are respectively fitted into the recessed portions 924, and therefore the the portable oil suction device can be conveniently carried by hand through the cross hand-hold portion 911. However, when the portable oil suction device is filled up with the engine oil and carried by hand, the protruding portions 923 of the tubular top flange 922 tend to break. Another drawback of this structure of portable oil suction device is that the oil sealing ring 943, which seals the gas between the bottom cover 95 and the oil tank 95 tends to be damaged, causing an oil leakage. Furthermore, the floating control valve 96 is expensive to manufacture and complicated to install because the float 963 of the floating control valve 96 is mounted on two separate metal plates 998 and 999.

SUMMARY OF THE INVENTION

The present invention has been accomplished to provide a portable oil suction device which eliminates the aforesaid drawbacks. According to one aspect of the present invention, the portable oil suction device comprises a solid oil tank, a top cover securely fixed to the top open end of the oil tank and having a unitary handle for carrying by hand, a pump cylinder disposed inside the oil tank, a plunger moved in the pump cylinder to induce a suction force for drawing the engine oil from the engine into the oil tank, and a control valve carried on a link on the bottom side of the top cover and controlled by a float to stop the air passage on the top cover when the engine oil in the oil tank reaches the high oil level. The handle of the top cover defines an elongated horizontal chamber, which receives the cross hand-hold portion of the plunger when the plunger is not operated.

According to another aspect of the present invention, the oil tank has a closed bottom side protected by a bottom plate.

According to still another aspect of the present invention, the link is made from a metal plate by a punching machine and connected between the bottom side of the top cover and the float to carry the control valve.

DETAILED DESCRIPTION OF THE PREFERRED EMBODIMENT

Figure 1:
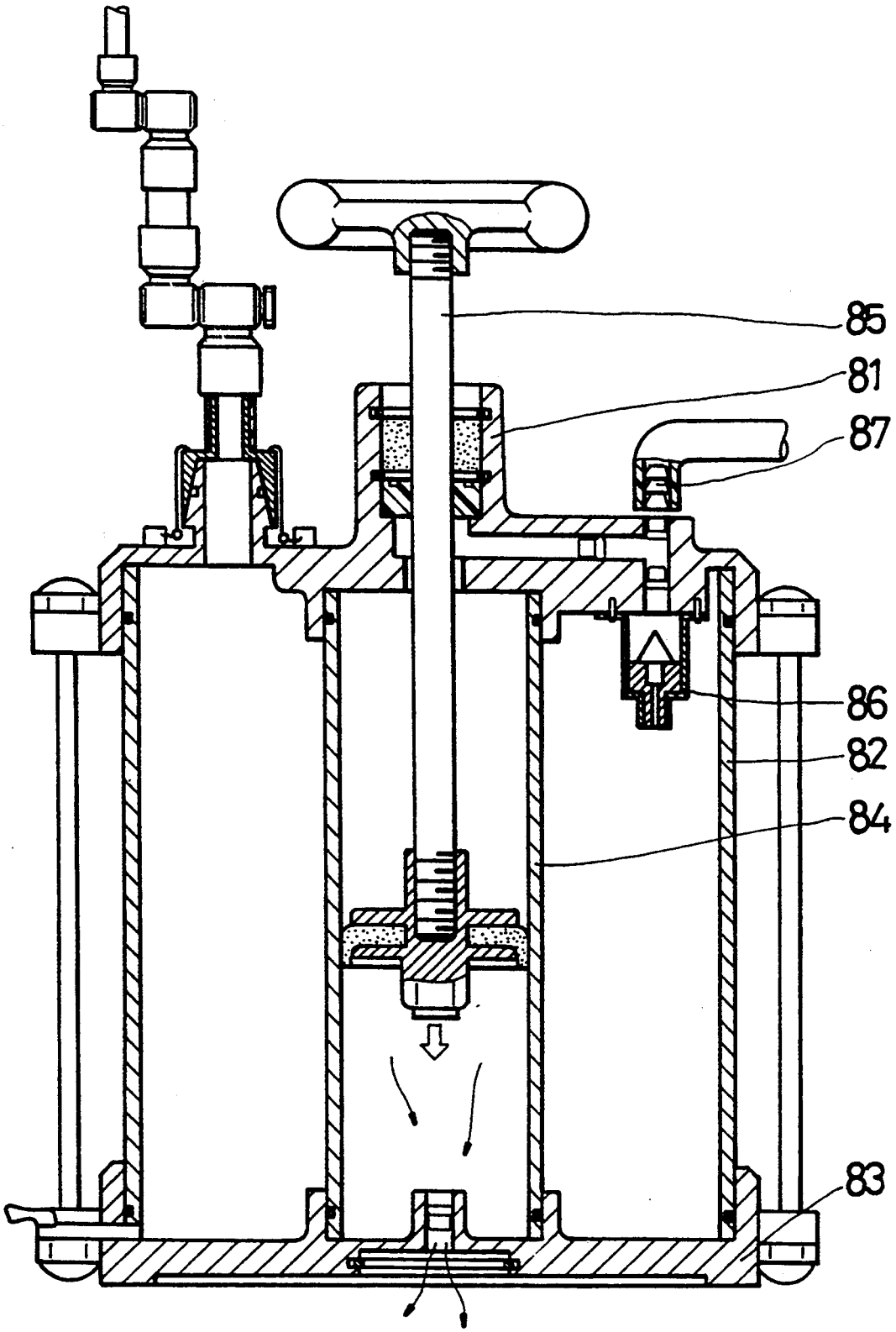
FIG. 1 PRIOR ART
FIG. 1 is a sectional elevation of a portable oil suction device according to the prior art.
Figure 2:
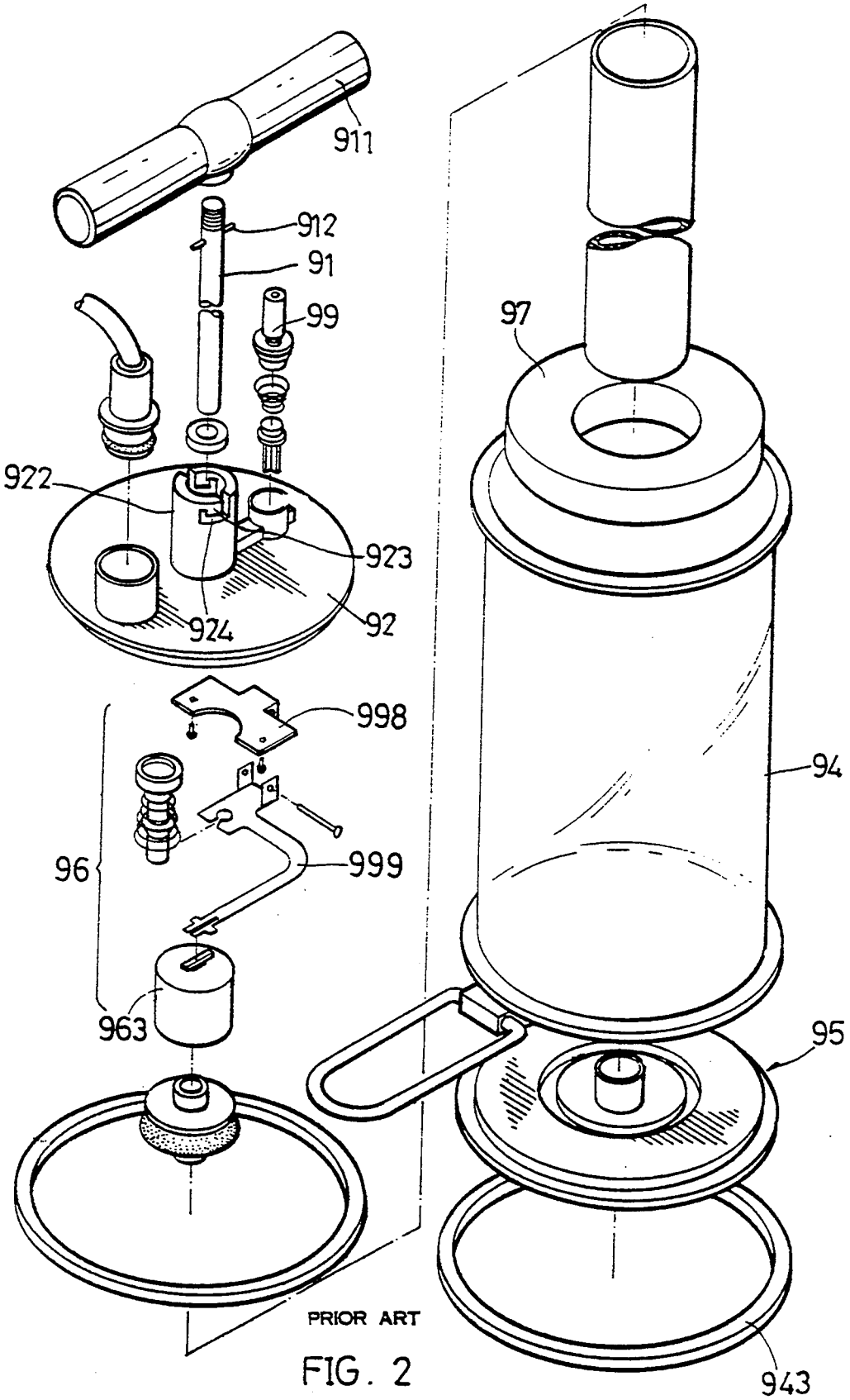
PRIOR ART FIG. 2
FIG. 2 is an exploded view of another structure of portable oil suction device according to the prior art.
Figure 3:
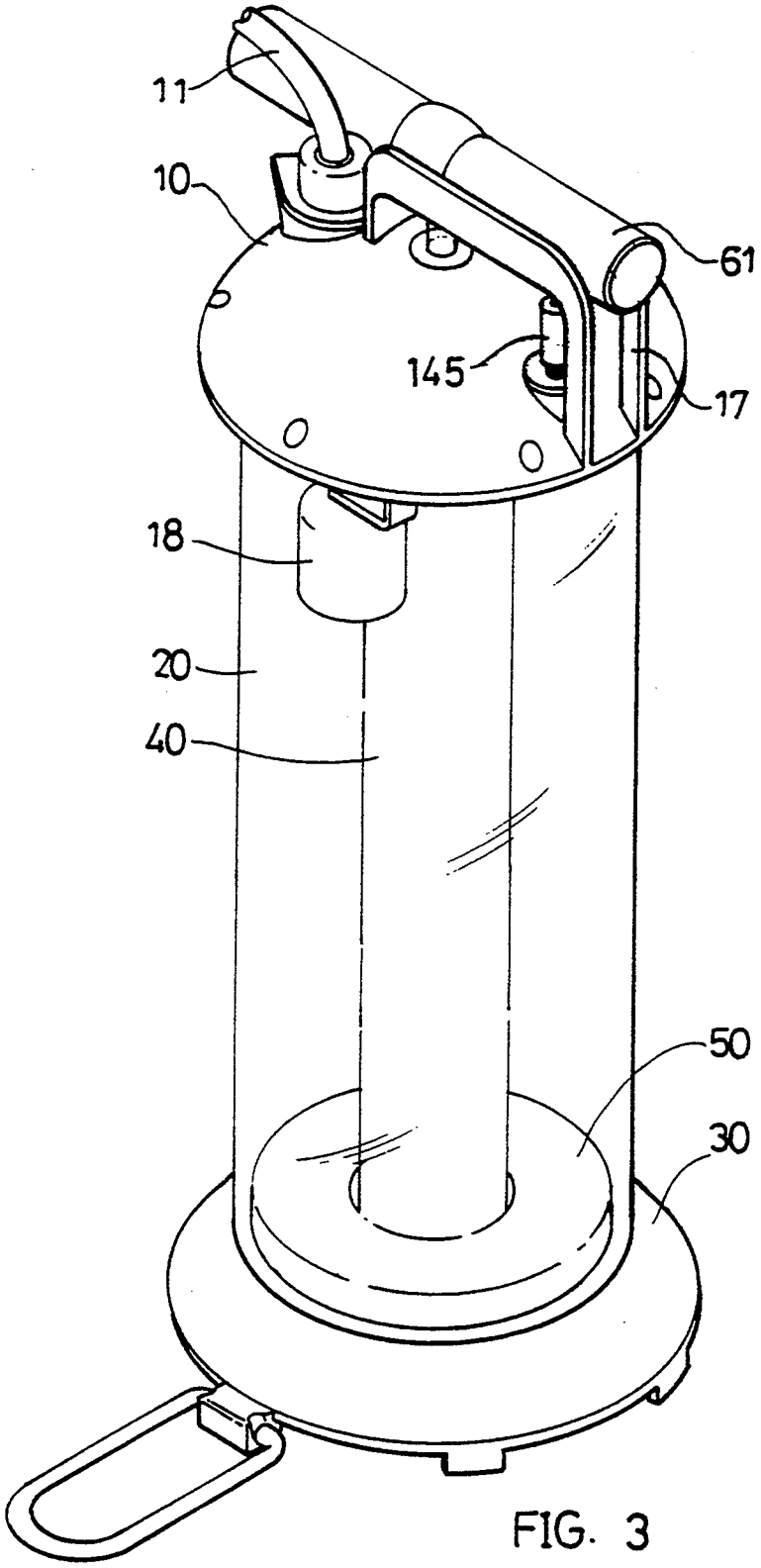
FIG. 3 is an elevational view of a portable oil suction device.

Referring to FIGS. from 3, 4, 5, and 6, a portable oil suction device in accordance with the present invention is generally comprised of a top cover 10, an oil tank 20, a bottom plate 30, a pump cylinder 40, a hollow annular air bag 50, and a plunger 60.

The top cover 10 comprises, a center through hole 12 sealed by a seal ring 121, an oil hole 13 near the border, a flexible siphon tube 11 connected to the oil hole 13, a transverse air passage 14 communicated with the center through hole 12, a longitudinal air passage 15 communicated with the transverse air passage 14, a control valve 16 installed in the bottom end of the longitudinal air passage 15, a float 18 received inside the oil tank 20, a link 19 connected between the float 18 and the control valve 16, a handle 17 raised from the top side thereof, an upper relief valve 145 installed in the top end of the longitudinal air passage 15, an one-way air valve 146 installed in the longitudinal air passage 15 between the upper relief valve 145 and the control valve 16, and a spring 147 mounted inside the longitudinal air passage 15 between the upper relief valve 145 and the one-way air valve 146 to give a downward pressure to the one-way air valve 146.

Figure 6:
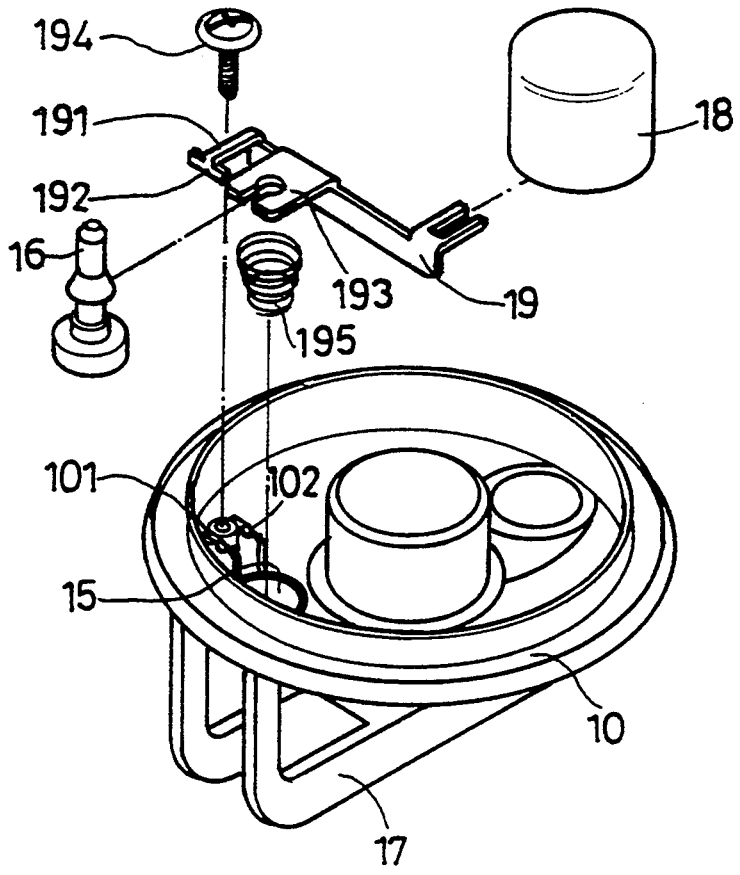
FIG. 6 is an exploded view of the top cover for the portable oil suction device shown in FIG. 3.

Referring to FIG. 6 again, the link 19 is made from a metal plate by a punching machine, having a coupling portion 191 pivotably connected to a recess 102 on a bottom bearing block 101 of the top cover 10 by a headed screw 194, an angled rear end 192 stopped at the head of the headed screw 194, a bearing portion 193 in the middle connected to a bottom spring 195 on the top cover 10 to hold the control valve 16 in the bottom end of the longitudinal air passage 15. The opposite end of the link 19 is connected to the float 18. When the float 18 moves upwards, the link 19 is forced to move the control valve 16 into the bottom end of the longitudinal air passage 15, causing the longitudinal air passage 15 stopped.

Figure 4:
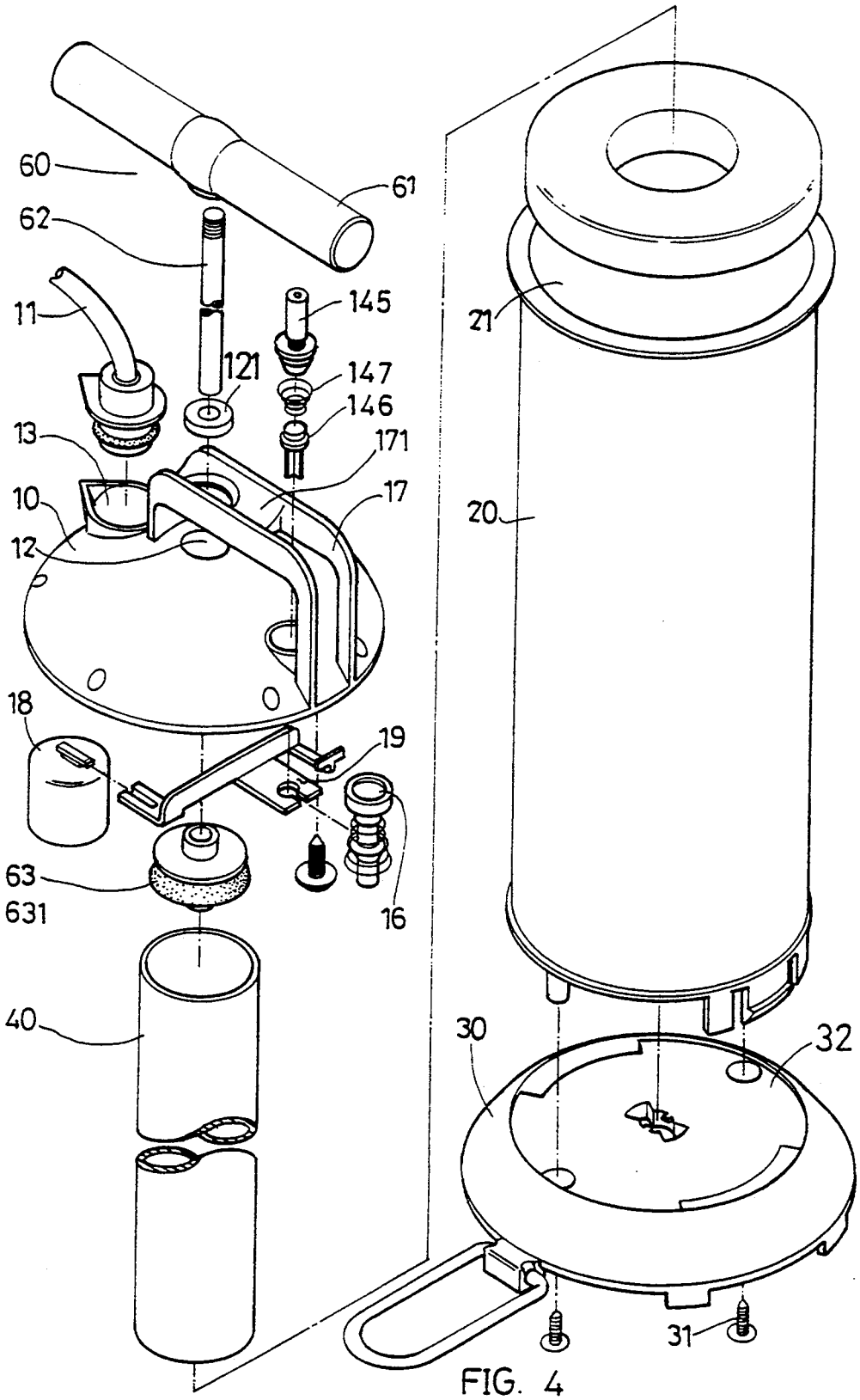
FIG. 4 is an exploded view of the portable oil suction device shown in FIG. 3.
Figure 5:
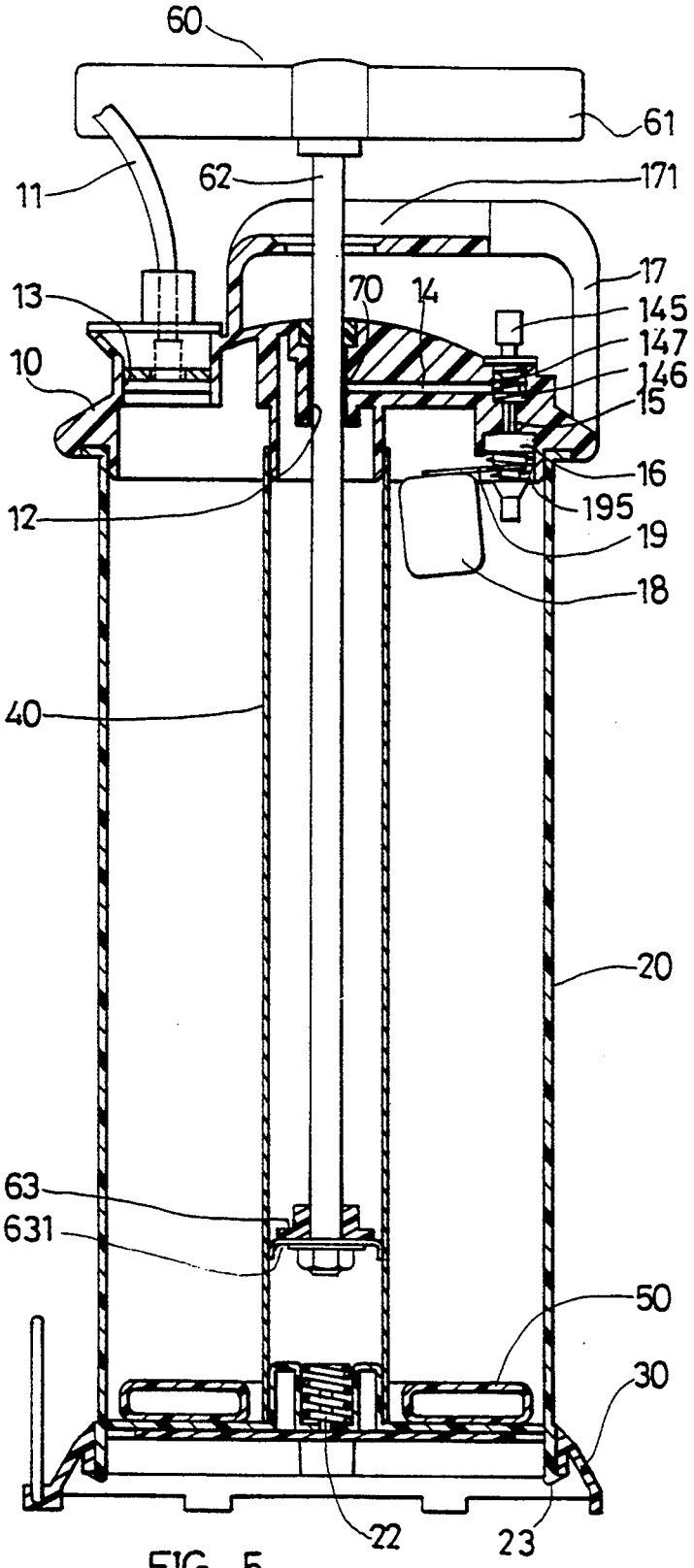
FIG. 5 is a longitudinal view in section of FIG. 3.

Referring to FIGS. 4 and 5 again, the oil tank 20 has a top opening 21 covered by the top cover 10, a relief valve 22 at the center of the closed bottom side, and a plurality of bottom hooks 23 spaced around the border of the bottom side. The bottom plate 30 is securely fixed to the bottom side of the oil tank 20 by screws 31 and the bottom hooks 23 of the oil tank 20, having a top recess 32, which receives the bottom side of the oil tank 20. The pump cylinder 40 is securely mounted inside the oil tank 20 at its longitudinal center axis. The hollow annular air bag 50 is mounted around the pump cylinder 40 inside the oil tank 20 to eliminate bubbles from the engine oil during the oil suction operation of the oil suction device. The plunger 60 comprises a plunger rod 62 inserted through the seal ring 121 into the pump cylinder 40, a cross hand-hold portion 61 connected to one end of the plunger rod 62 and disposed outside the top cover 10, and a piston 63 connected to the opposite end of the plunger rod 62 and moved by it in the pump cylinder 40. When the plunger 60 is moved to the lowest position, the cross hand-hold portion 61 is received within an elongated horizontal chamber 171 on the handle 17 of the top cover 10. There is a gap 70 defined between within the center through hole 12 around the plunger rod 62 below the seal ring 121. The piston 63 has a valve flap 631 fitting the inside wall of the pump cylinder 40. When the piston 63 is reciprocated in the pump cylinder 40, the valve flap 631 permits air to be compressed downwards, however the valve flap 631 prohibits air to flow from the space below the piston 63 to the space above the piston 63. When the plunger 60 is moved downwards, the piston 63 is forced to compress air inside the pump cylinder 40, causing compressed air to escape from the relief valve 22. During the down stroke of the piston 63, the air pressure inside the pump cylinder 40 above the piston 63 is relatively reduced. This low pressure induces a suction force to draw air from the oil tank 20 into the pump cylinder 40 through the control valve 16, the longitudinal air passage 15, the one-way air valve 146, the transverse air passage 14, and the gap 70. During the up stroke of the piston 63, the longitudinal air passage 15 is stopped by the one-way air valve 146, and the air inside the pump cylinder 40 above the piston 63 is forced into the space below the piston 63 through the gap between the inside wall of the pump cylinder 40 and the valve flap 631 (because the valve flap 631 can be bent in one direction). When the aforesaid Up and down strokes are repeated alternatively, the engine oil is sucked into the oil tank 20, and the hollow annular air bag 50 is floated on the engine oil inside the oil tank 20 to eliminate bubbles. When the oil level in the oil tank 20 reaches a predetermined range, the float 18 will be floated to lift the link 19, causing the control valve 16 to stop the longitudinal air passage 15, and therefore the suction force is stopped. After the oil tank 20 has been filled up with the engine oil, the portable oil suction device can be conveniently carried to the desired location by hand through the handle 17, and the engine oil can be poured out of the oil tank 20 through the oil hole 13 after the removal of the siphon tube 11.

As indicated, the oil tank 20 is a solid unit with its bottom side received in the top recess 32 of the bottom plate 30, therefore the bottom side of the oil tank 20 is protected by the bottom plate 30 and will not be easily damaged to cause an oil leakage. When the plunger 60 is not operated, the hand-hold portion 61 can be received within the elongated horizontal chamber 171 on the handle 17 and stopped by the handle 17 from being turned horizontally.

What is claimed

1. A portable oil suction device comprising:

a top cover, which comprises a center through hole sealed by a seal ring, an oil hole near a border of said cover, a flexible siphon tube connected to aid oil hole, a transverse air passage communicating with said center through hole, a longitudinal air passage communicating with said transverse air passage, a control valve installed in a bottom end of said longitudinal air passage, a float received inside an oil tank, a link connected between said float and said control valve, a handle raised from a top side of said cover and defining an elongated horizontal chamber, a relief valve installed in a top end of said longitudinal air passage, a one-way air valve installed in said longitudinal air passage between said upper relief valve and said control valve, and a spring mounted inside said longitudinal air passage between said upper relief valve and said one-way air valve to give a downward pressure to said one-way air valve, said link being from a metal plate formed by a punching machine, having a coupling portion pivotably connected to a recess on a bottom bearing block on said top cover by a headed screw, an angled rear end stopping at the head of said headed screw, a bearing portion in the middle of said link connected to a bottom spring on said top cover to hold said control valve in the bottom end of said longitudinal air passage, and a front end connected to said float, said control valve being forced into the bottom end of said longitudinal air passage to stop air from passing through said longitudinal air passage when said float is moved upwards;

said oil tank having a top opening covered by said top cover, a closed bottom side, a relief valve at the center of said closed bottom side thereof, and a plurality of bottom hooks spaced around a border of said closed bottom side;

a bottom plate fastened to said bottom hooks of said closed bottom side of said oil tank, said bottom plate having a top recess, which receives said closed bottom side of said oil tank;

a pump cylinder securely mounted inside said oil tank at a longitudinal central axis of said oil tank;

a hollow annular air bag mounted around said pump cylinder inside said oil tank and movable vertically along said pump cylinder; and a plunger having a plunger rod inserted through said seal ring into said pump cylinder, a cross hand-hold portion connected to one end of said plunger rod and disposed outside said top cover, and a piston connected to an opposite end of said plunger rod and moved by said plunger rod in said pump cylinder, said cross hand-hold portion being received within said elongated horizontal chamber of said handle of said top cover when said plunger is moved to the lowest position, the outer diameter of said plunger rod being smaller than the inner diameter of said center through hole of said top cover, said piston having a valve flap fitting an inside wall of said pump cylinder, said valve flap permitting air to be compressed downwards but prohibiting said air from flowing upwards to a space above said piston when said piston is reciprocated in said pump cylinder.

* * * * *